US008833520B2

(12) United States Patent
Pizzolato

(10) Patent No.: US 8,833,520 B2
(45) Date of Patent: Sep. 16, 2014

(54) FALL SAFETY BARRIER

(75) Inventor: Mario Pizzolato, Mascot (AU)

(73) Assignee: C. & V. Engineering Company Pty Ltd, Mascot, New South Wales (AU)

( * ) Notice: Subject to any disclaimer, the term of this patent is extended or adjusted under 35 U.S.C. 154(b) by 325 days.

(21) Appl. No.: 12/518,883

(22) PCT Filed: Dec. 17, 2007

(86) PCT No.: PCT/AU2007/001943

§ 371 (c)(1),
(2), (4) Date: Jul. 10, 2009

(87) PCT Pub. No.: WO2008/070933

PCT Pub. Date: Jun. 19, 2008

(65) Prior Publication Data

US 2010/0299999 A1 Dec. 2, 2010

(30) Foreign Application Priority Data

Dec. 15, 2006 (AU) ..... 2006906992

(51) Int. Cl.

| | |
|---|---|
| ***E04G 21/32*** | (2006.01) |
| ***E02D 29/14*** | (2006.01) |
| ***A47F 5/00*** | (2006.01) |
| ***E02D 29/12*** | (2006.01) |

(52) U.S. Cl.

CPC ..... *E04G 21/3204* (2013.01); *E02D 29/127* (2013.01); *E02D 29/12* (2013.01)

USPC ..... 182/113; 52/20; 160/135

(58) Field of Classification Search

USPC ..... 182/113; 52/20; 49/56; 160/135

See application file for complete search history.

(56) References Cited

U.S. PATENT DOCUMENTS

| | | | | | |
|---|---|---|---|---|---|
| 14,107 | A | * | 1/1856 | Moore | 49/56 |
| 470,689 | A | * | 3/1892 | Lee | 182/113 |
| 3,630,491 | A | * | 12/1971 | Puccio | 256/64 |
| 4,266,380 | A | * | 5/1981 | Samolis | 52/19 |
| 5,289,655 | A | * | 3/1994 | Marmora et al. | 49/141 |

(Continued)

FOREIGN PATENT DOCUMENTS

GB 2043142 A * 10/1980

*Primary Examiner* — Alvin Chin-Shue

(74) *Attorney, Agent, or Firm* — Molins & Co. Pty Ltd

(57) ABSTRACT

A fall safety barrier for use around a hole has anchor means removably secured adjacent a perimeter of the hole, first collapsible barrier means pivotally mounted about a first pivot location of the anchor means, and second collapsible barrier means pivotally mounted about a second pivot location of the anchor means opposite the first location. There are means for allowing the first collapsible barrier means to pivot between a first contracted position, where it lays upon the second collapsible barrier means, and a first expanded position, where it is upright and forms a first side of the fall safety barrier. There are also means for allowing the second collapsible barrier means to pivot between a second contracted position, where it lays adjacent the anchor means, and a second expanded position, where it is upright and forms a second side of the fall safety barrier opposite the first side. First linking barrier means are located between adjacent first ends of the first and second collapsible barrier means and form a third side of the fall safety barrier. Second linking barrier means are located between adjacent second ends of the first and second collapsible barrier means and form a fourth side of the fall safety barrier opposite the third side.

6 Claims, 12 Drawing Sheets

(56) References Cited

U.S. PATENT DOCUMENTS 5,588,500 A * 12/1996 Yonahara ..... 182/141
6,061,966 A * 5/2000 Nelson et al. ..... 49/394
6,830,127 B2 * 12/2004 Johnson ..... 182/113

* cited by examiner 10
32
50
33
39
41
36a
36c
28a
24
36b
36d
28b

FALL SAFETY BARRIER

FIELD OF THE INVENTION

The present invention relates to improved fall safety barriers and, in particular, to a collapsible and portable barrier for use in multi-storey building construction sites for safeguarding workers against falls down holes.

Although the invention will be hereinafter described with reference to a fall safety barrier for use in such multi-storey building construction sites, it is to be understood that the invention is not limited thereto but has wider application. For example, the improved fall safety barrier may be used in the field of telecommunications where underground cables need to be accessed through manholes, or in the course of sewer maintenance where workers need to descend into pits. Also, it is to be understood that the terminology employed herein is for the purpose of description only and should not be regarded as limiting. For instance, the terms "comprising" or "comprises" are to be understood as meaning "including", unless otherwise stated.

BACKGROUND OF THE INVENTION

In the building construction industry, the safety of workers has become a paramount concern. This is particularly so in the construction of multi-storey buildings where it has been acknowledged that a fall of greater than 1.8 metres can be fatal. On such sites, there may be many risks of falls, and one of these is the risk of a worker falling through a formwork penetration or cavity destined to become a column of the multi-storey building, and within which a prefabricated steel reinforcement cage is to be lowered prior to filling with concrete to create the column.

Conventionally, a formwork penetration is covered by a plywood board or the like, which is normally nailed down to the surrounding structure. A message is then spray painted onto the plywood board warning of the danger of a fall if the board is removed or excessive weight is applied thereon. A major risk of a fall arises when the plywood board is removed in order to lower a steel reinforcement cage within the formwork penetration, at which time there are numerous workers standing around the now uncovered and unprotected penetration trying to carefully manoeuvre the cage downwardly into position with the aid of a crane. With their attention fixed on the reinforcement cage, the workers may fail to notice that they are stepping dangerously close to the penetration and accidentally fall into it.

It has been found by the present inventor that the risk of a worker falling down a formwork penetration in a multi-storey building may be substantially eliminated by providing a fall safety barrier that, when the penetration is not in use, is in a collapsed state for covering the penetration, and when the penetration is in use, is in an upright state for preventing workers stepping dangerously close to the penetration.

SUMMARY OF THE INVENTION

It is an object of the present invention to overcome or substantially ameliorate the disadvantages and shortcomings of the aforementioned prior art, or at least provide a useful alternative.

It is another object of the present invention to provide an improved fall safety barrier that is simple, lightweight and inexpensive to manufacture, can be easily installed and used by any worker, and is reliable in operation over a long period of time, as well as being collapsible and portable from one hole to another.

According to the present invention there is provided a fall safety barrier for use around a hole, comprising:

(a) anchor means removably secured adjacent a perimeter of the hole, (b) first collapsible barrier means pivotally mounted about a first pivot location of the anchor means, (c) second collapsible barrier means pivotally mounted about a second pivot location of the anchor means opposite the first location, (d) means for allowing the first collapsible barrier means to pivot between a first contracted position, where it lays upon the second collapsible barrier means, and a first expanded position, where it is upright and forms a first side of the fall safety barrier, (e) means for allowing the second collapsible barrier means to pivot between a second contracted position, where it lays adjacent the anchor means, and a second expanded position, where it is upright and forms a second side of the fall safety barrier opposite the first side, (f) first linking barrier means located between adjacent first ends of the first and second collapsible barrier means and forming a third side of the fall safety barrier, and (g) second linking barrier means located between adjacent second ends of the first and second collapsible barrier means and forming a fourth side of the fall safety barrier opposite the third side.

Preferably, the anchor means comprises a pair of first and second, parallel spaced apart, anchor members, the first pivot location of the anchor members being at adjacent first ends thereof, and the second pivot location of the anchor members being at adjacent second ends thereof.

It is preferred that each of the first and second anchor members include a bracket which is adapted to be fastened to a structure surrounding the hole by removable fastening means.

In a preferred form, the first and second collapsible barrier means are supported in their respective expanded positions by strut means pivotally connected at first ends thereof to the anchor means.

The strut means preferably comprise four strut rods, each collapsible barrier means having removably connected at each of the opposite sides thereof a second end of a respective strut rod.

Preferably, the first and second collapsible barrier means each comprise mesh gates, which are ideally made of steel.

The first and second linking barrier means preferably each comprise one or more chains that extend between adjacent ends of the mesh gates.

Alternatively, the first and second linking barrier means may each comprise mesh gates.

In a preferred form, the barrier further includes brace means pivotally mounted about a top portion of the first collapsible barrier means, and means for allowing the brace means to pivot between a third contracted position, where it lays against the first collapsible barrier means, and a third expanded position, where it extends crosswise and interconnects the top portions of the first and second collapsible bather means.

According to another aspect of the present invention, there is provided a method for assembling the above described fall safety barrier of the invention around a hole, comprising the steps of:

(a) removably securing the anchor means around the hole, (b) pivoting the first collapsible barrier means from the first contracted position to the first expanded position so as to form a first side of the fall safety barrier, (c) pivoting the second collapsible barrier means from the second contracted position to the second expanded position so as to form a second side of the fall safety barrier opposite the first side, and whereby the first and second linking barrier means can form respective third and fourth sides of the fall safety barrier.

Preferably, the method includes the step of removably connecting strut means, which are pivotally connected at first ends thereof to the anchor means, to each of the first and second collapsible barrier means so as to support the barrier means when in their expanded positions.

There has been thus outlined, rather broadly, the more important features of the invention in order that the detailed description thereof that follows may be better understood and put into practical effect, and in order that the present contribution to the art may be better appreciated. There are additional features of the invention that will be described hereinafter. As such, those skilled in the art will appreciate that the conception, upon which the disclosure is based, may be readily utilized as the basis for designing other structures and methods for carrying out the objects of the present invention. It is important, therefore, that the broad outline of the invention described above be regarded as including such equivalent constructions in so far as they do not depart from the spirit and scope of the present invention.

SUMMARY OF THE DRAWINGS

The invention will be better understood and objects other than those set forth above will become apparent when consideration is given to the following detailed description thereof. Such description makes reference to the accompanying drawings, in which.

DESCRIPTION OF PREFERRED EMBODIMENTS

Figure 1:
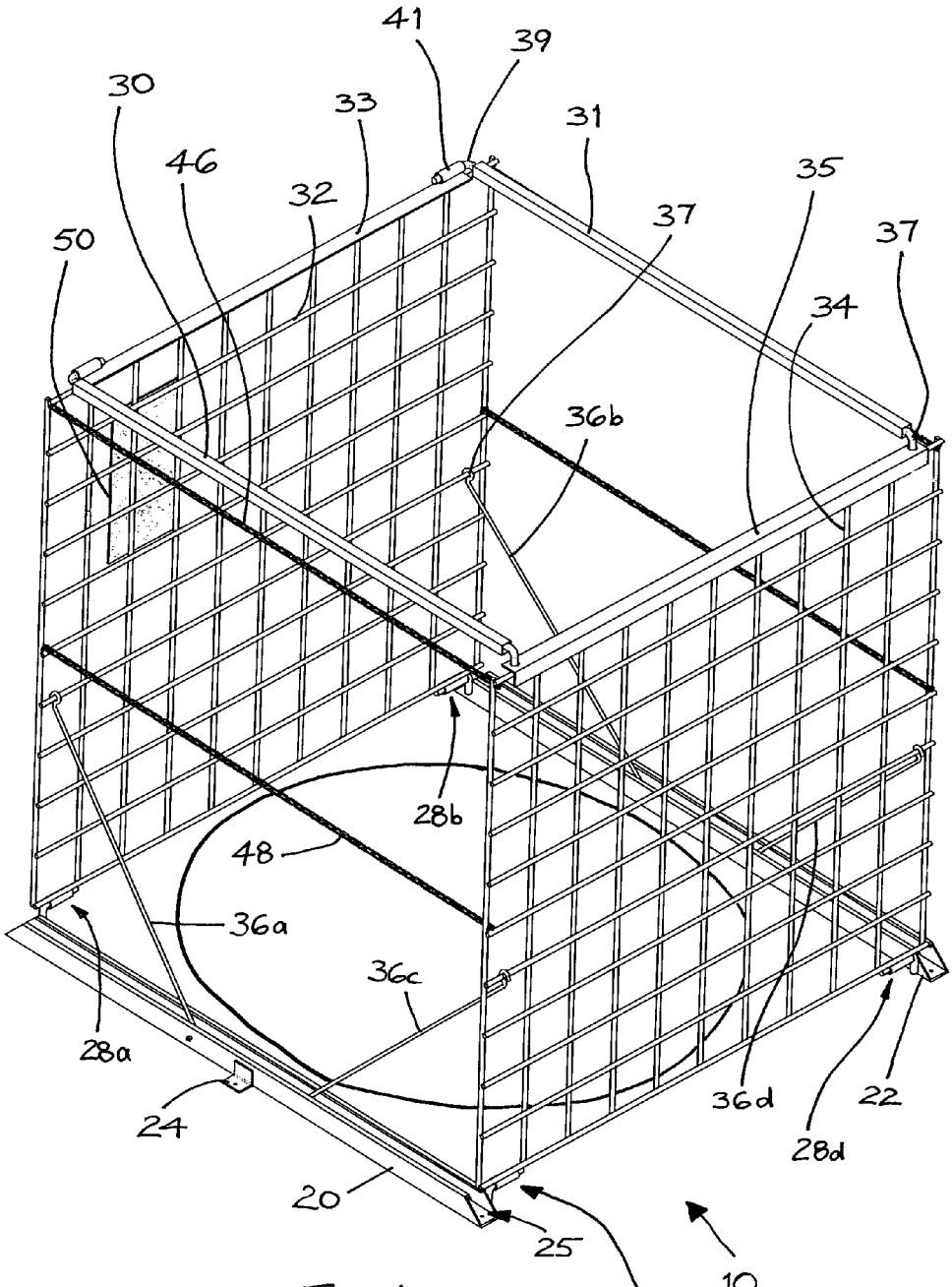
FIG. 1 is a perspective view of a fall safety barrier, when assembled, according to a preferred embodiment of the invention.
Figure 2:
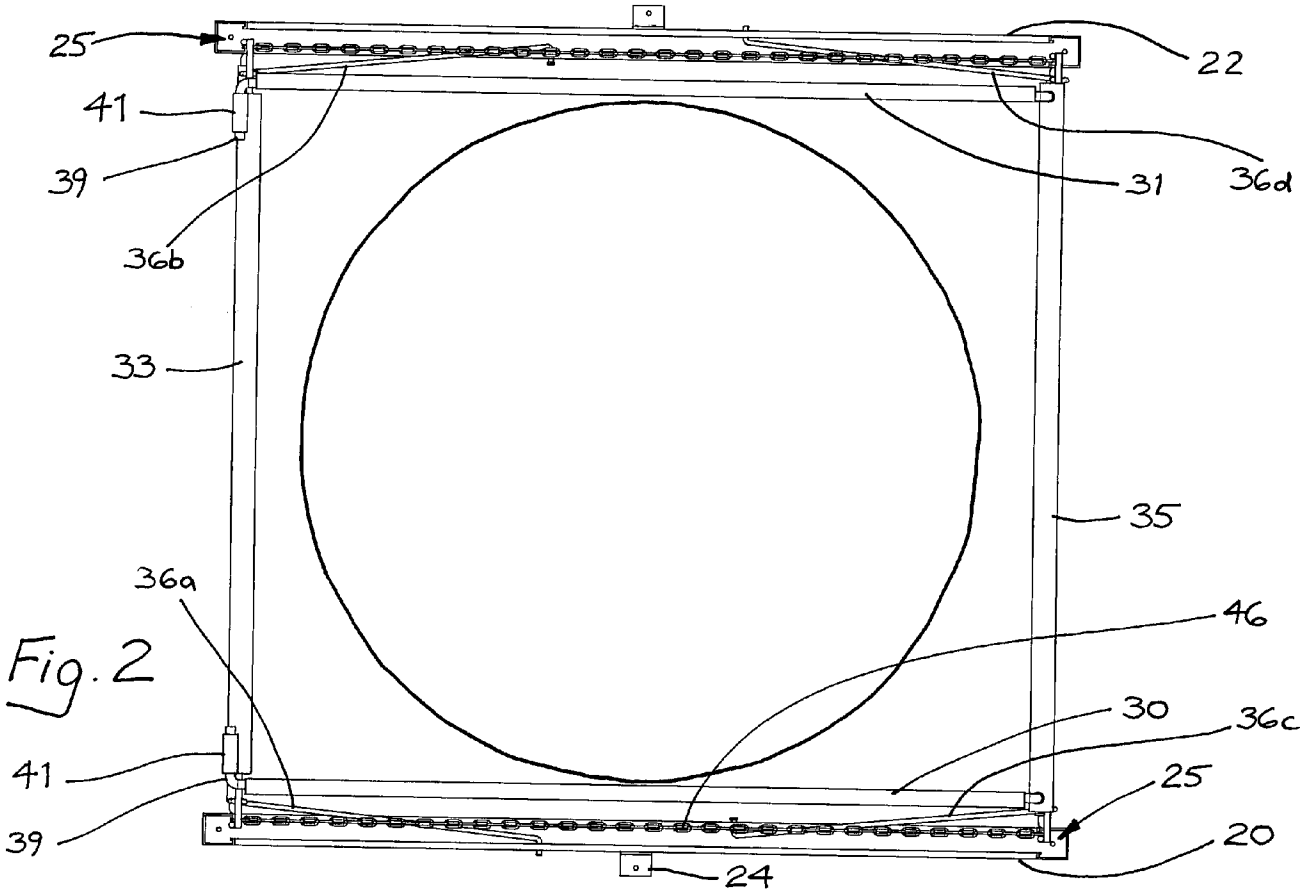
FIG. 2 is a plan view of the fall safety barrier shown in FIG. 1.
Figure 3:
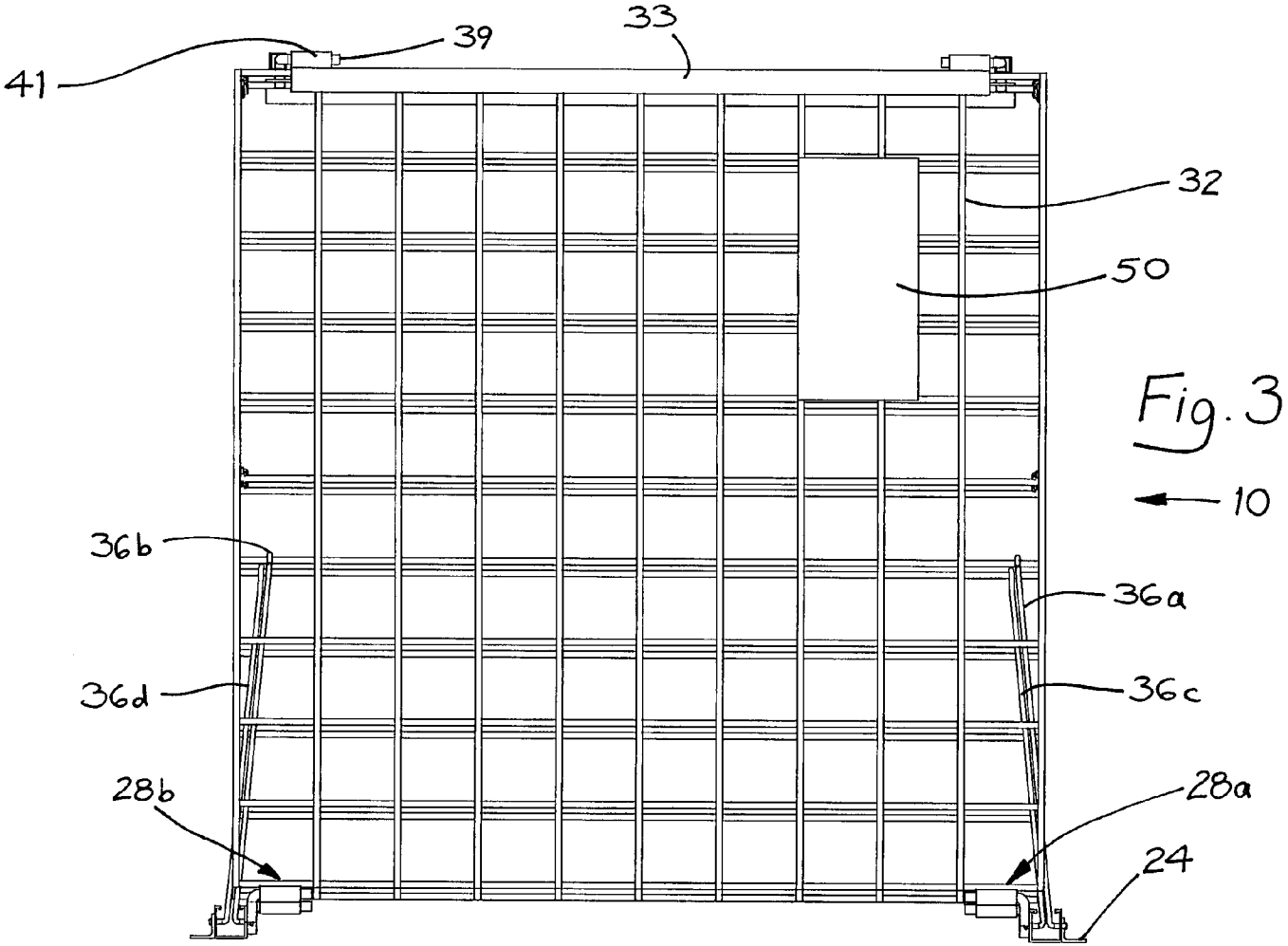
FIG. 3 is a first side view of the fall safety barrier shown in FIG. 1.
Figure 4:
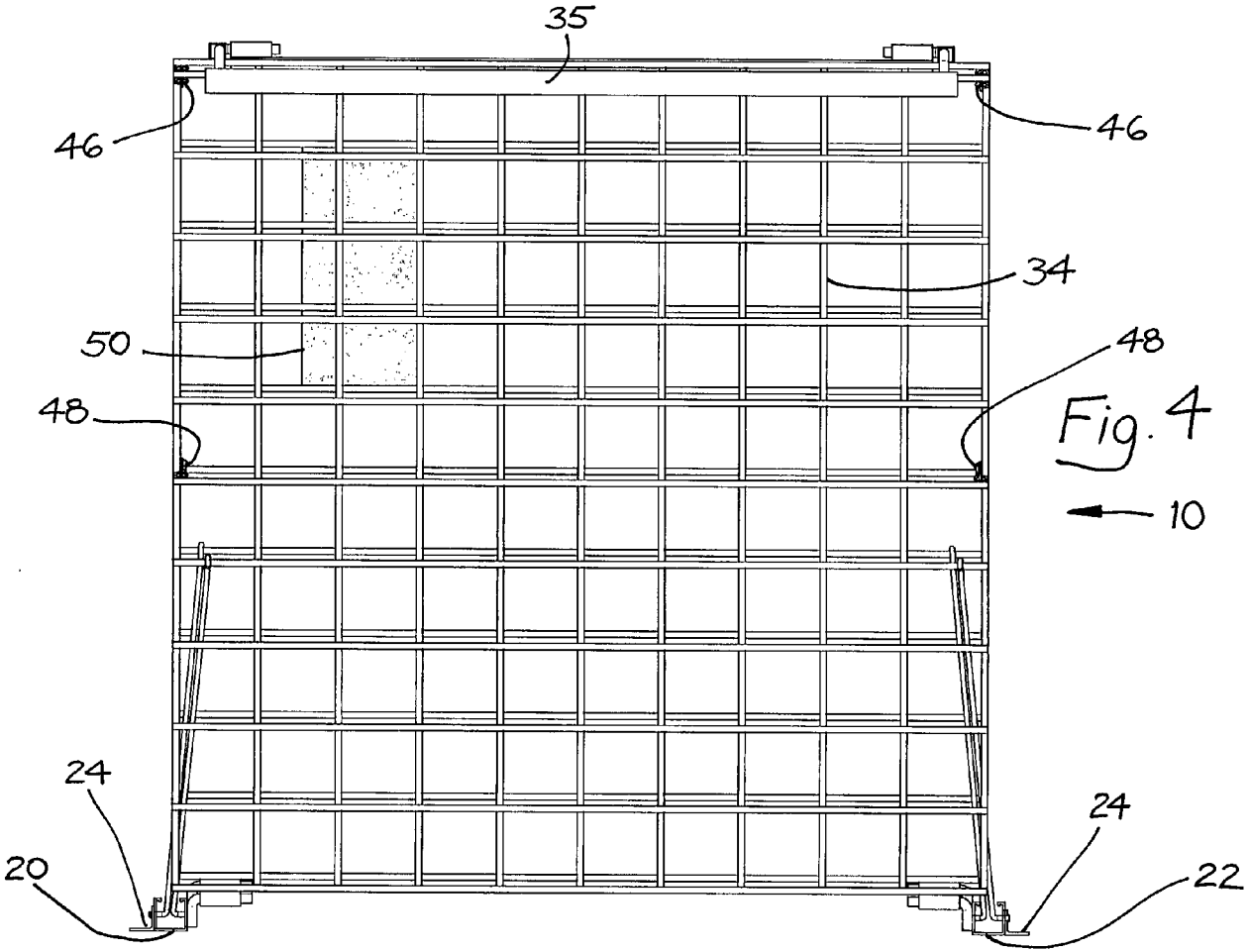
FIG. 4 is a second side view of the fall safety barrier shown in FIG. 1.
Figure 5:
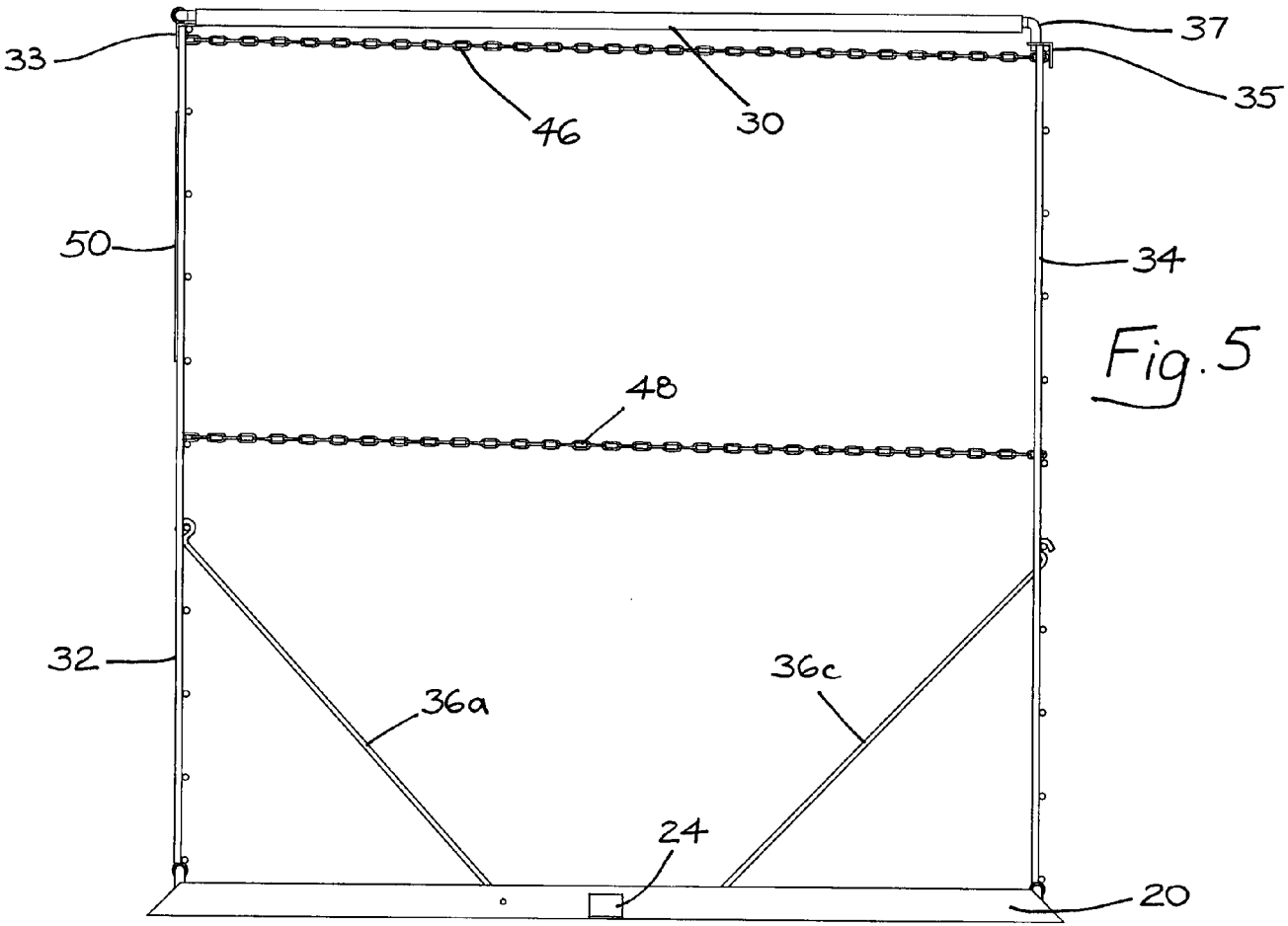
FIG. 5 is a third (or fourth) side view of the fall safety barrier shown in FIG. 1.

With reference now to the above summarized drawings, and in particular to FIGS. 1 to 12 thereof, an improved fall safety barrier embodying the principles and concepts of the present invention and generally designated by the reference numeral 10 will now be described.

The fall safety barrier 10 has the general features of an anchor means, first and second collapsible barrier means, means for allowing the first and second collapsible barrier means to pivot between contracted and expanded positions, first and second linking barrier means, and, in this preferred embodiment, brace means.

The anchor means comprises a pair of anchor members 20, 22 which are located in a parallel spaced apart relationship, and are removably secured adjacent a perimeter of a hole, such as a formwork penetration (shown in FIGS. 1, 2, 6 and 7), through brackets 24 and securing holes 25. Each bracket 24 is L-shaped, with its vertical portion welded midway along the outer side of its respective anchor member, and has an aperture formed through its horizontal portion for receiving a removable fastening means, such as a bolt, to fasten the fall safety barrier to the concrete, metal or wooden structure surrounding the hole. A similar fastening means is received through the securing holes 25.

Each anchor member 20, 22 is, in this embodiment, a U-shaped channel, at the opposite ends of which are welded hinge assemblies 28 for the first and second collapsible barrier means.

Each of the first and second collapsible barrier means comprise steel mesh gates 32, 34. The first mesh gate 32 is pivotally mounted about a first pivot location of the anchor members 20, 22 consisting of the hinge assemblies 28*a*, 28*b* which are at adjacent first ends of the anchor members. The second mesh gate 34 is pivotally mounted about a second pivot location of the anchor members 20, 22 consisting of the hinge assemblies 28*e*, 28*d* which are at adjacent second ends of the anchor members.

The first mesh gate 32 is able to pivot between a first contracted position (see FIGS. 6 to 8), where it lays upon the second mesh gate 34, and a first expanded position (see FIGS. 1 and 8), where it is upright and forms a first side of the fall safety barrier.

The second mesh gate 34 is able to pivot between a second contracted position (see FIGS. 6 to 10), where it lays adjacent the anchor members 20, 22, and a second expanded position (see FIGS. 1 and 10), where it is upright and forms a second side of the fall safety barrier opposite the first side.

The first and second mesh gates 32, 34 are supported in their expanded or upright positions by strut means in the form of strut rods 36.

Figure 9:
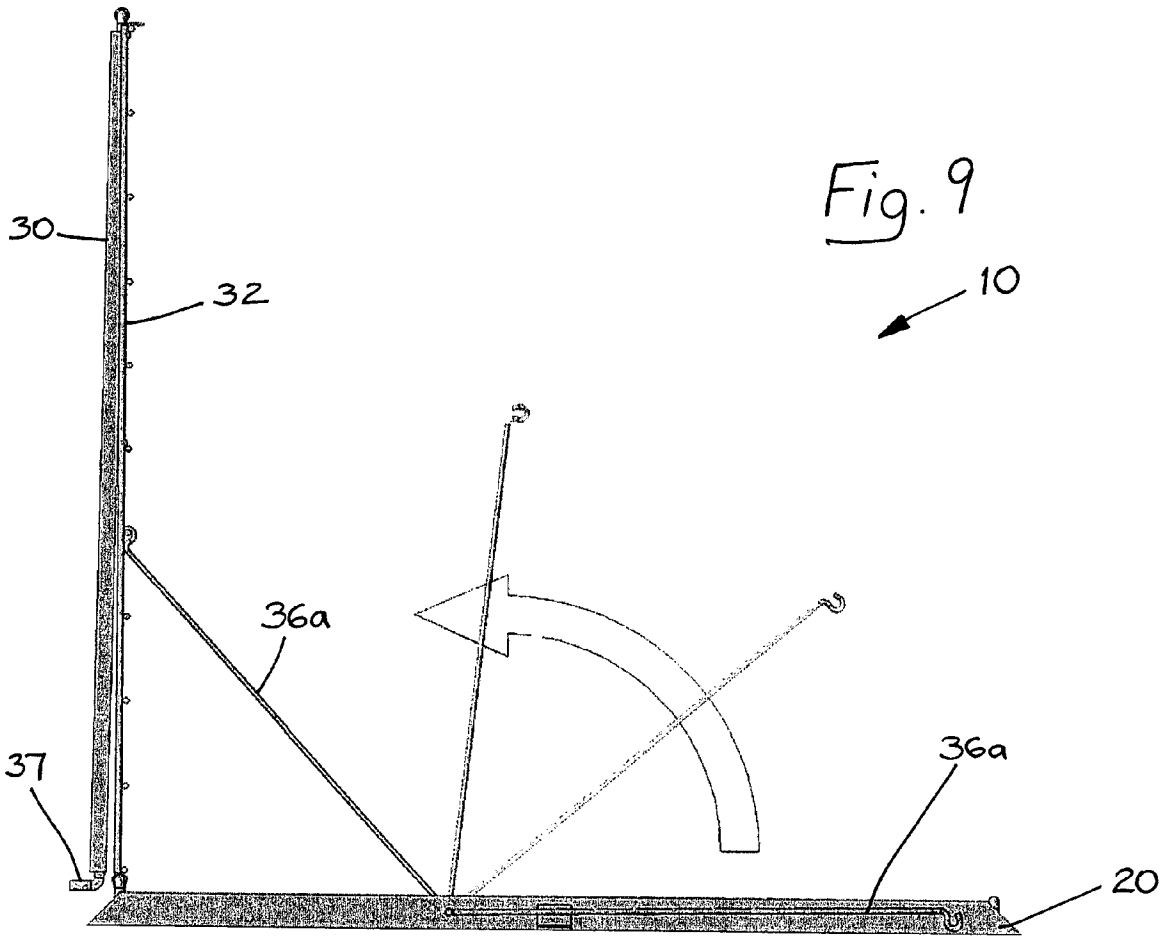
FIG. 9 is a similar view to FIG. 8 showing strut means being connected to the first collapsible barrier means.

The expanded position of the first mesh gate 32 is supported by strut rods 36*a*, 36*b*, each of which has a first end that is pivotally mounted to a respective anchor member 20, 22 and a second end that is removably connected to a respective end of an inwardly facing side of the gate 32, as shown in FIG. 9.

Figure 11:
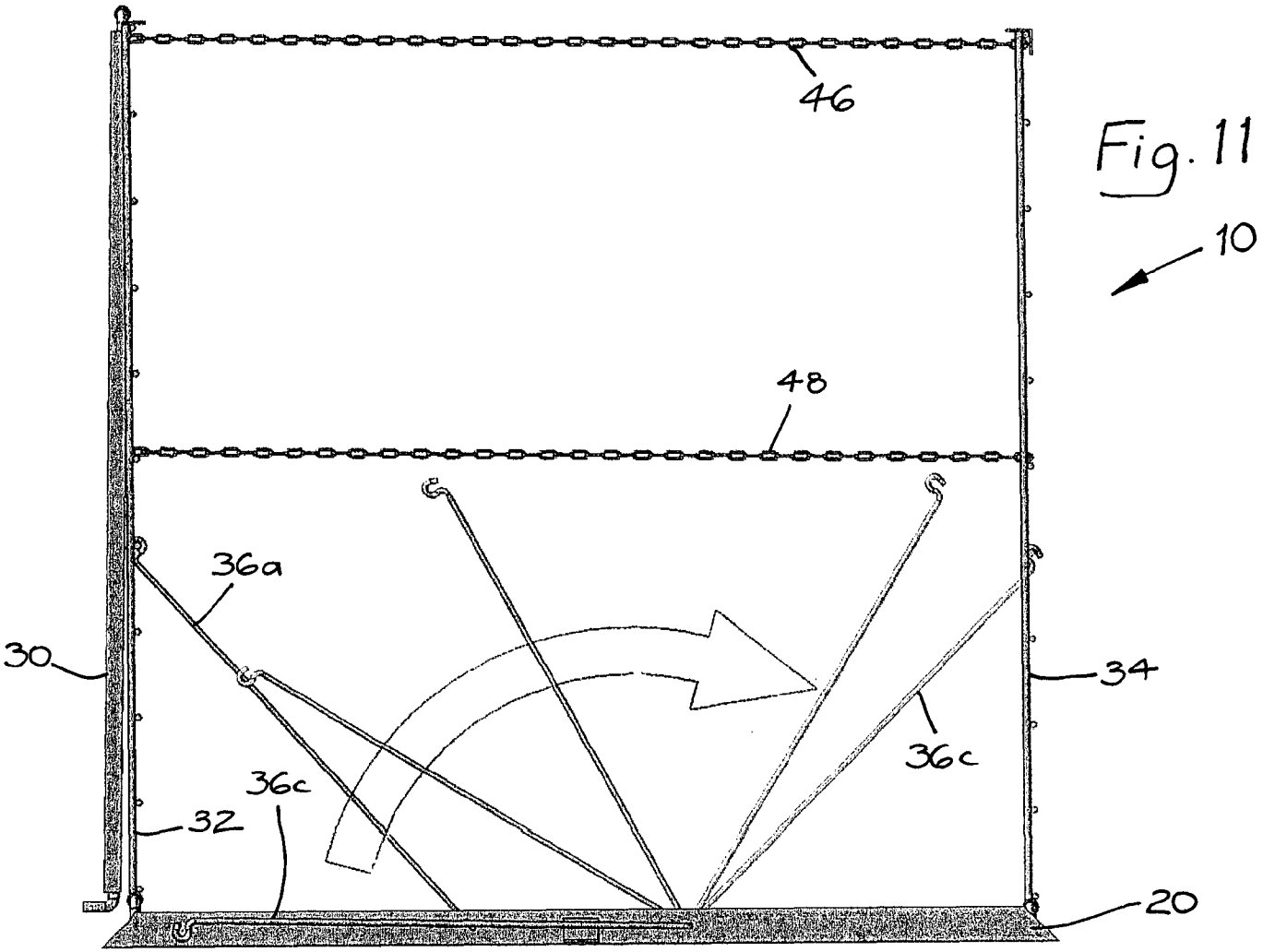
FIG. 11 is a similar view to FIG. 10 showing strut means being connected to the second collapsible barrier means.

The expanded position of the second mesh gate 34 is supported by strut rods 36*c*, 36*d*, which similarly interconnect the gate 34 and the anchor members 20, 22, as shown in FIG. 11.

Each strut rod 36 has a hooked second end 37 that engages around a cross member of its respective mesh gate, and a pinned first end that engages a hole in a side wall of its respective anchor member 20, 22.

Upon the first and second mesh gates 32, 34 assuming their expanded positions, the first and second linking barrier means are formed. Each of the first and second linking barrier means are, in this embodiment, a pair of chains 46, 48 that extend between respective adjacent ends of the mesh gates. An upper chain 46 links across the top of adjacent corners of the mesh gates, and a lower chain 48 links across the middle of adjacent ends of the mesh gates.

Although not shown, the first and second linking barrier means may comprise third and fourth mesh gates that are inserted and locked into position after the first and second mesh gates have been pivoted to their expanded positions.

Brace means, in the form of a pair of brace rods 30, 31 are separately, pivotally connected at opposite ends of a top flange 33 of the first mesh gate 32. The brace rods 30, 31 can pivot between a third contracted position, when the mesh gate 32 is upright and the brace rods 30, 31 lay thereagainst (see FIGS. 8 to 11), and a third expanded position where they extend crosswise and interconnect the top flanges 33, 35 of the mesh gates 32, 34 respectively (see FIGS. 1 and 12).

Each brace rod 30, 31 has a hooked second end 37 that engages a respective hole in the top flange 35 of the mesh gate 34, and an axled first end 39 that engages a respective tube 41 secured to the top flange 33 of the mesh gate 32.

Welded to the first mesh gate 32 is a plate 50 for providing relevant visual information thereon.

Figure 6:
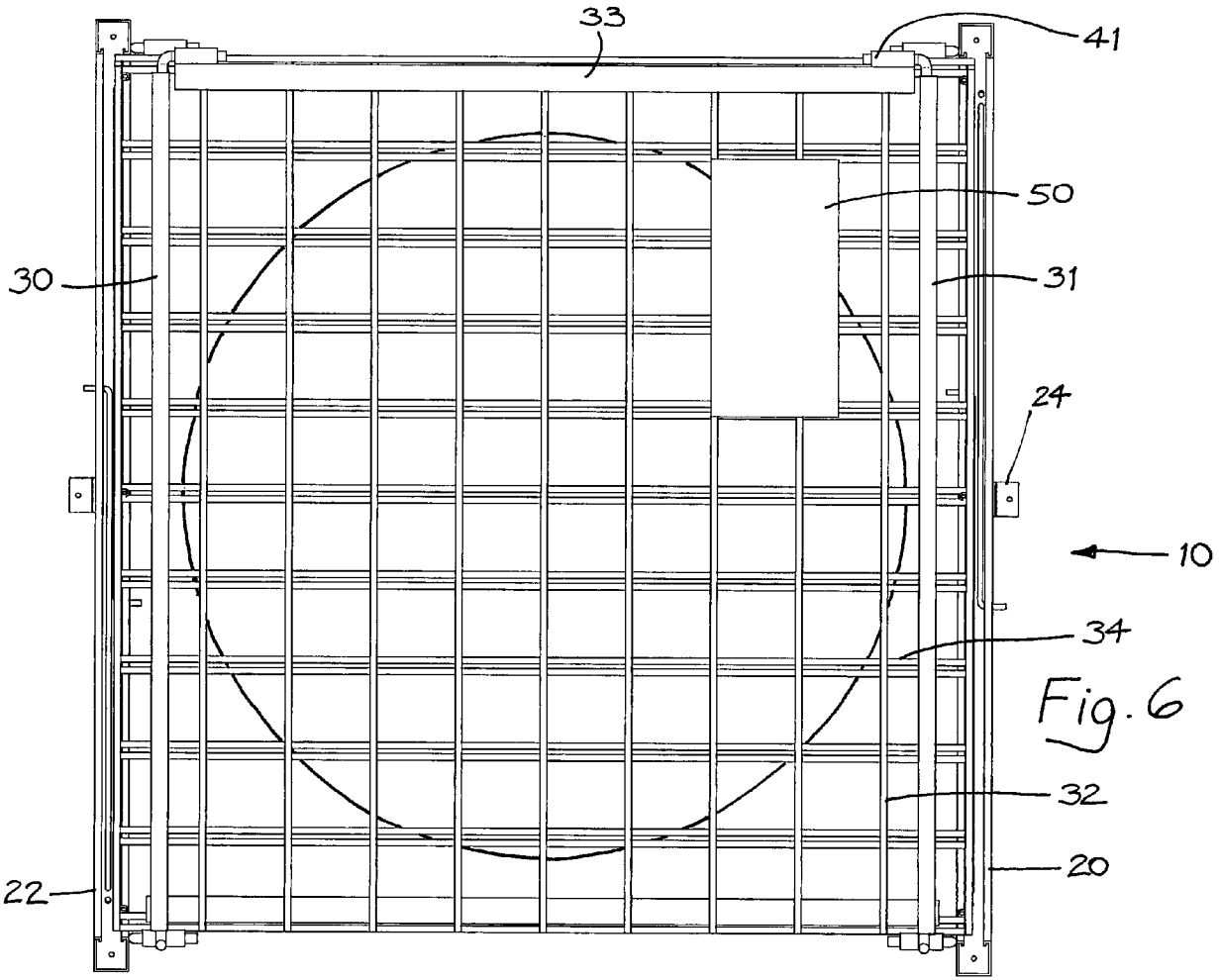
FIG. 6 is a perspective view of the fall safety barrier when it is in a collapsed state around a hole.
Figure 7:
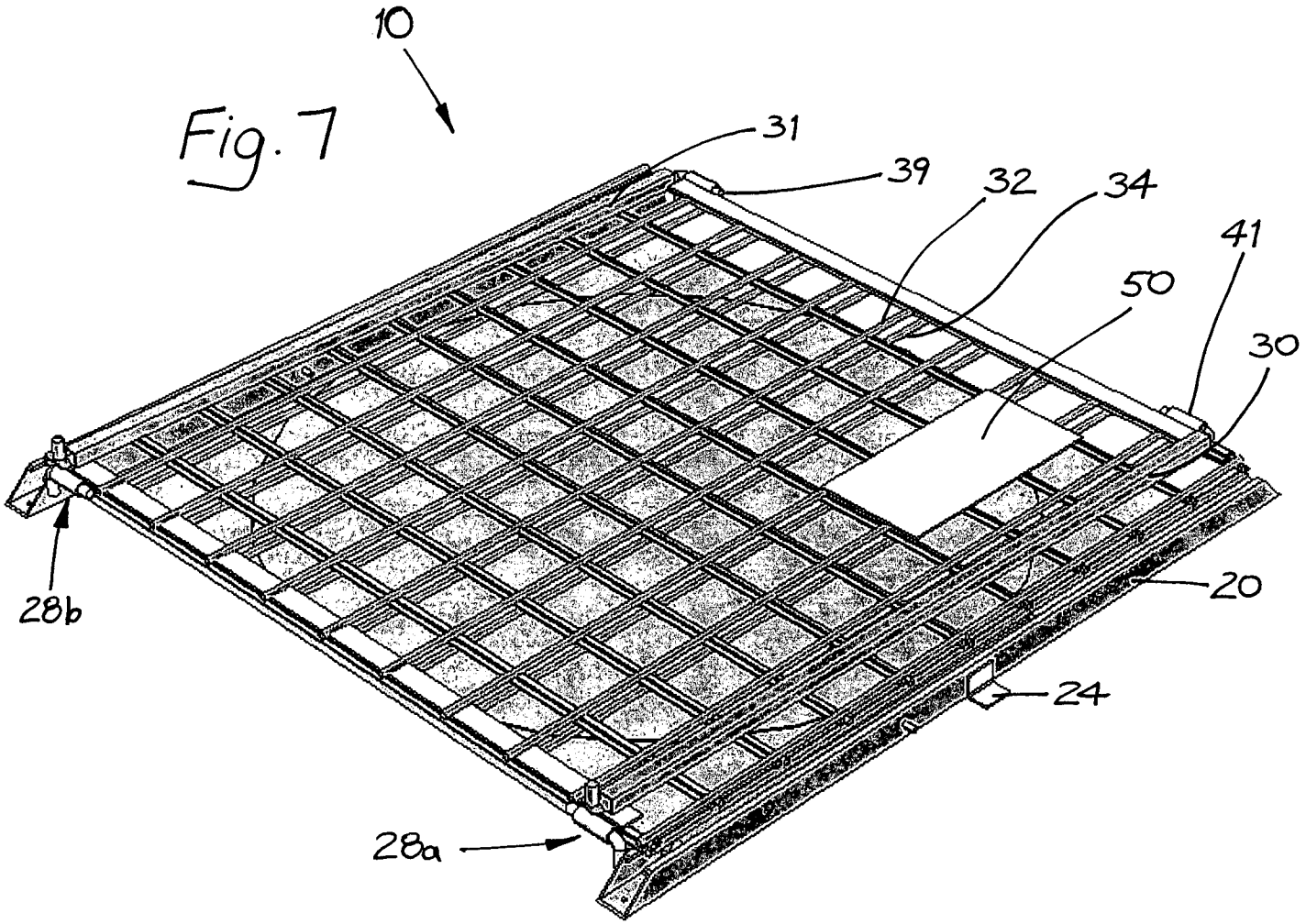
FIG. 7 is a perspective view of the fall safety barrier when it is in a collapsed state so as to show the first and second collapsible barrier means in their contracted positions.

In use, the fall safety barrier is installed in a collapsed state around a hole, such as a formwork penetration, by means of the anchor members being removably secured via the brackets 24 and securing holes 25 to a concrete, metal or wooden structure surrounding the hole (see FIGS. 6 and 7).

Figure 8:
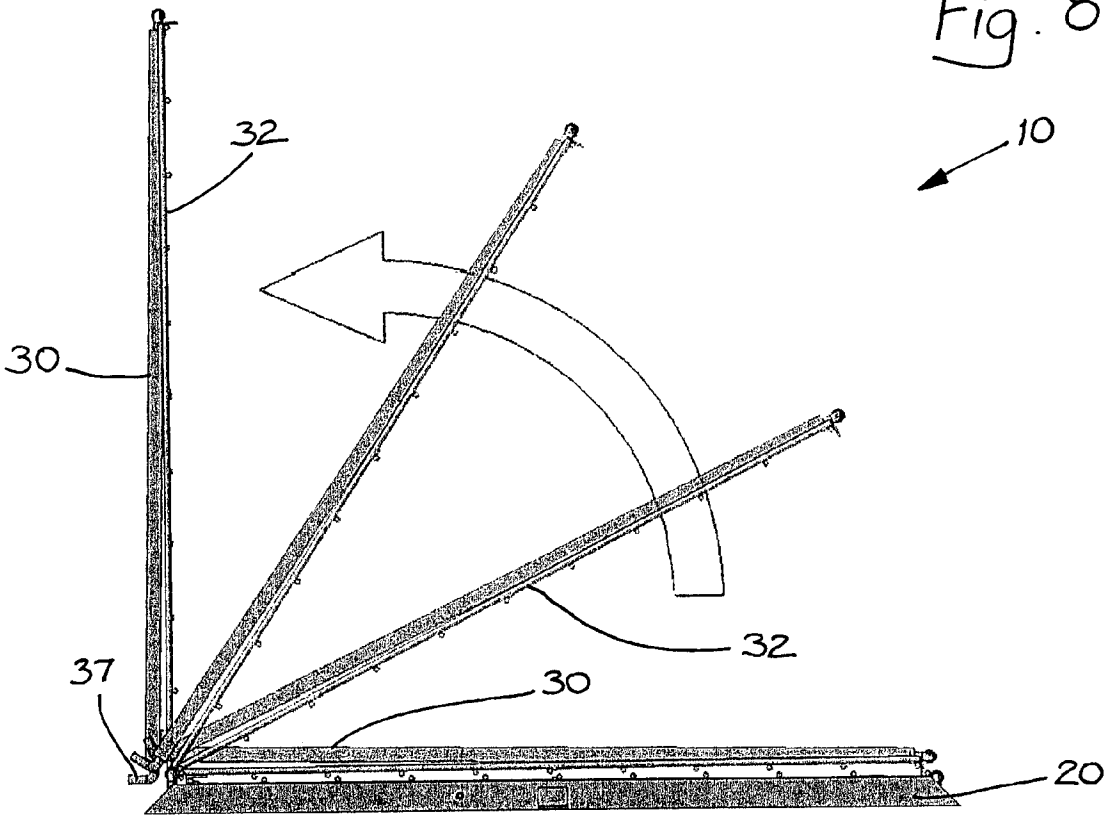
FIG. 8 is a side view of the fall safety barrier of FIGS. 1 to 7 showing the first collapsible barrier means being pivoted to the first expanded position.

The first mesh gate 32 is then pivoted by the user from the first contracted position to the first expanded position, during which time the brace rods 30, 31 are also raised upright with the gate 32, but lay or hang against the outside of the gate 32 (see FIG. 8).

The second end of one or both of the strut rods 36*a*, 36*b* is then engaged to the gate 32 to maintain it upright (see FIG. 9). If only one strut rod is engaged to the gate 32 at this stage, the other strut rod is engaged at a later stage as required.

Figure 10:
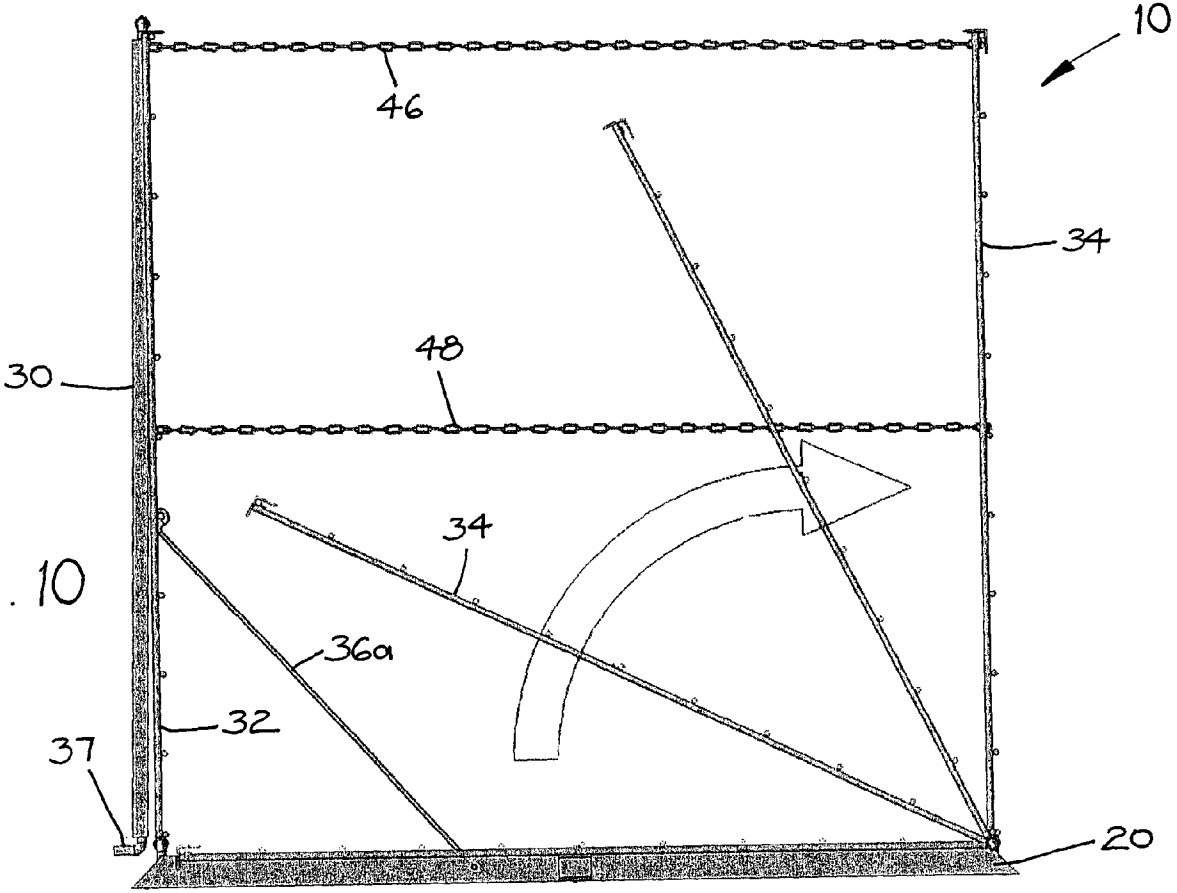
FIG. 10 is a side view of the fall safety barrier of FIG. 9 showing the second collapsible barrier means being pivoted to a second expanded position, and showing the chains that form the third and fourth sides of the fall safety barrier.

The second mesh gate 34 is then pivoted by the user from the second contracted position to the second expanded position, during which time the chains 46, 48 are elevated to their linking positions (see FIG. 10).

The second end of one or both of the strut rods 36*c*, 36*d* is then engaged to the gate 34 to maintain it upright (see FIG. 11). If only one strut rod is engaged to the gate 34 at this stage, the other strut rod is engaged at a later stage as required.

The first and second mesh gates 32, 34 thereby form the first and second opposed sides of the fall safety barrier 10, with the third and fourth opposed sides thereof being formed by the chains 46, 48.

Figure 12:
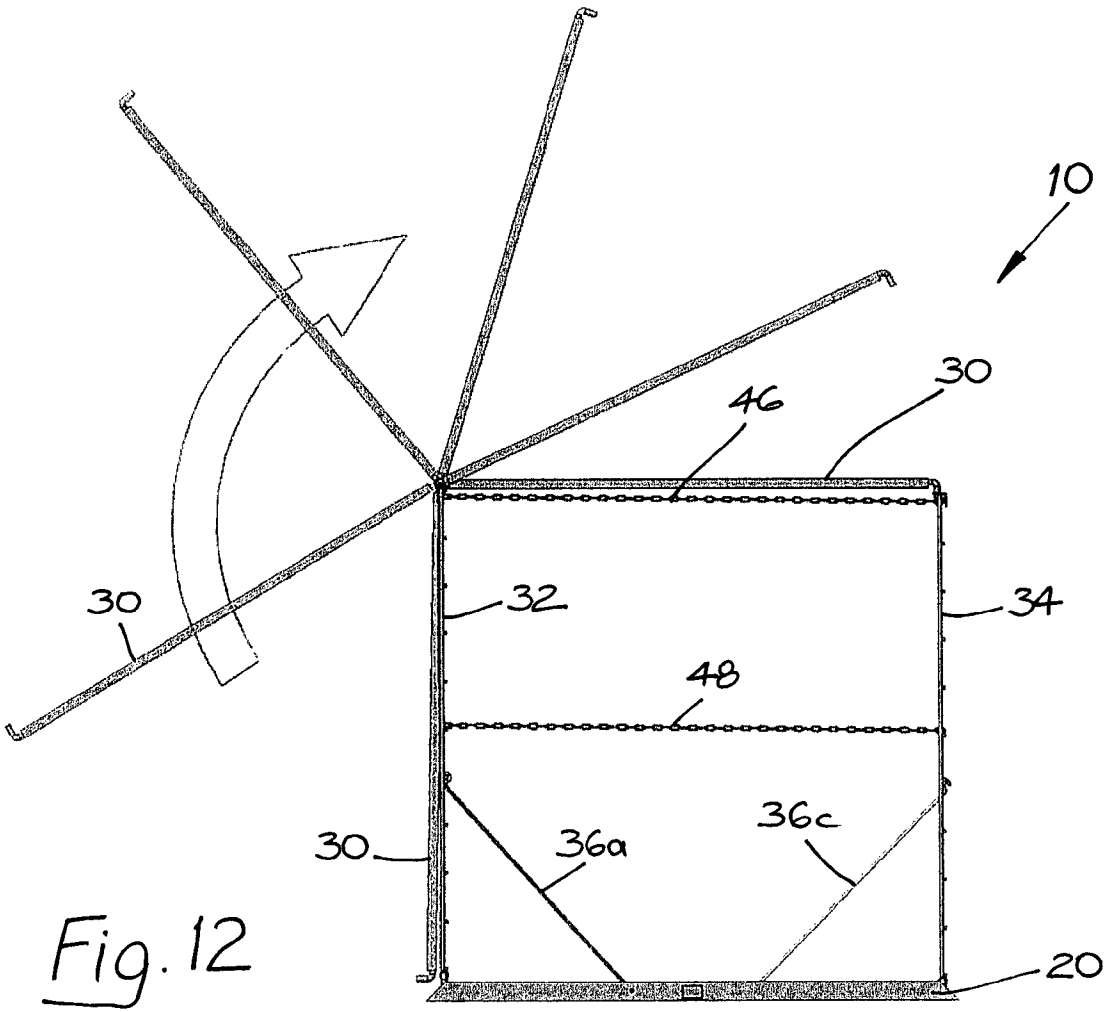
FIG. 12 is a side view of the fall safety barrier of FIG. 11 showing the brace means being pivoted to a third expanded position.

The brace rods 30, 31 are also pivoted from their third contracted position to their third expanded position where their second ends engage the top flange 35 of the gate 34 to provide added strength and safety to the assembled barrier 10 (see FIG. 12).

The fall safety barrier 10, having been so assembled into an upright state, can subsequently resume its collapsed state by the user carrying out the above mentioned steps in reverse.

It will be readily apparent from the above that there are various advantages of the present invention. The primary advantage is the provision of a safe working environment around a hole, both when the fall safety barrier is in a collapsed state and in an upright state. When in an upright state, the barrier means of the fall safety barrier can only collapse inwardly, which prevents any injury to workers who may improperly assemble or mishandle the fall safety barrier. Still further advantages of the present invention will be apparent to persons skilled in the art.

It will also be readily apparent to persons skilled in the art that various modifications may be made in details of design and construction of the improved fall safety barrier described above without departing from the scope or ambit of the present invention.

The description of the prior art herein is not to be taken as implying that the prior art forms part of the common general knowledge in this field before the filing date of this patent application.

What is claimed is:

1. A portable, collapsible fall safety barrier device, comprising:

two separate and parallel anchor members, spaced apart from one another by a first and second collapsible mesh gates each gate having an expanded and a contracted position;

the collapsible gates each being hinged to both of the separate anchor members;

each anchor member carrying a pair of pivoting struts, the struts being a first strut that is removably connected to the first mesh gate and a second strut that is connected to the second mesh gate;

the gates each having a top portion, one of said gate having pivoting brace rods pivotally attached to its top portion and extensible from a contracted position in which the brace rods lays against said one of said gate, to an expanded position in which the brace rod interconnects the top portion of the other of said gate;

the gates forming first and second opposed sides of a four sided barrier, chains extending between the gates to form third and fourth opposed sides;

the chains being affixed to the gates in both the expanded and contracted positions.

2. The device of claim 1, wherein:

each anchor member comprises at least one through opening for receiving a fastener.

3. The device of claim 1, wherein:

the gates are maintained in an upright orientation by the struts.

4. The device of claim 3, wherein:

the anchors are both U shaped channels.

5. The device of claim 1, wherein:

each brace rod as a free end that removably engages an opening in a gate.

6. The device of claim 1, wherein:

the chains are affixed to the gates so that the third and fourth sides are elevated into a linking position as the gates assume an expanded position.

* * * * *